US005772459A

United States Patent [19]

Swart

[11] Patent Number: 5,772,459

[45] Date of Patent: Jun. 30, 1998

[54] ROTATIONALLY ACTUATED COMPLIANT ELECTRICAL CONNECTOR

[75] Inventor: Mark A. Swart, Anaheim Hill, Calif.

[73] Assignee: Delaware Capital Formation, Inc., Wilmington, Del.

[21] Appl. No.: 622,317

[22] Filed: Mar. 15, 1996

[51] Int. Cl.[6] ..... H01R 9/09

[52] U.S. Cl. ..... 439/341; 439/376

[58] Field of Search ..... 439/341, 376, 439/338, 325, 326

[56] References Cited

U.S. PATENT DOCUMENTS

| | | | |
|---|---|---|---|
| 4,838,806 | 6/1989 | Igarashi | 439/341 |
| 4,941,837 | 7/1990 | Nakamura | 439/341 |
| 5,273,462 | 12/1993 | Huser et al. | 439/341 |
| 5,478,249 | 12/1995 | Crestin | 439/341 |
| 5,601,445 | 2/1997 | Schipper et al. | 439/341 |

*Primary Examiner*—Hein Vu
*Attorney, Agent, or Firm*—Christie, Parker & Hale, LLP

[57] ABSTRACT

A rotationally actuated compliant electrical connector includes a male connector member having an elongated body with a head at one body end, and a female connector member having a generally hollow body with an internal cavity. The male connector member includes at least one electrical contact disposed within the head adjacent a tip. The head is positioned perpendicular to the male connector member body. The female connector member includes at least one electrical contact disposed within the cavity and adapted to connect with respective electrical contacts of the male connector member when the head of the male connector member is rotatably displaced within the cavity. The male and female connector members are each adapted to accommodate pivoting rotational movement of the head within the cavity to produce electrical connection between respective electrical contacts. The male and female connector members each include a complementary mechanism to provide releasable locking attachment between the male and female connector members, when electrical connection between respective electrical contacts is achieved, that is independent of the electrical contacts.

21 Claims, 4 Drawing Sheets

10
14
16
18
22
24
26
28
30
32
34
36
38
40
42
44
46
50
52
56
58
60
61
62
70
72
74
80

ROTATIONALLY ACTUATED COMPLIANT ELECTRICAL CONNECTOR

FIELD OF THE INVENTION

The present invention relates to compliant electrical connectors and, more particularly, to a rotationally actuated electrical connector having enhanced contact force and minimized connection actuation force.

BACKGROUND OF THE INVENTION

Conventional compliant electrical connectors often include a first and a second connector member that each contain a number of electrical contacts. The electrical contacts are connected to electrically conductive wires from an electrical supply source, an electrically powered object, or a signal generating or receiving object. The connector members are configured to engage and connect with one another so that the electrical contacts of each member make contact and remain in contact with one another until such time as the members are separated.

Typically, connector members are constructed in the form of a male and a female member, so that electrical contacts of the male member are adapted to enter and be inserted into electrical contacts of the female member. A contact force is associated with each electrical connection between respective electrical contacts to ensure that a sufficient degree of electrical contact is made, and to ensure that the connector members do not become accidentally separated.

For a compliant electrical connector comprising a number of electrical contacts, the contact force for the connector is multiplied by the number of electrical contacts it contains. For example, if the contact force for a single electrical contact is one ounce, the corresponding contact force for a connector comprising 20 electrical contacts is twenty ounces. Conventional compliant electrical connectors are configured so that the contact force is approximately the same as the actuation force that must be exerted by the user when using the connector to make the connection.

Development in the area of electrical technology has resulted in the production of electrical products, such as computers and cellular phones, containing large numbers of electrical components, or containing electrical integrated components capable of performing numerous different functions. Such products require use of compliant electrical connectors to facilitate signal transfer or electrical connection with an external or off-board electrical device, source or the like. Conventional complaint connectors used in such applications are constructed to accommodate large numbers of electrical contacts, which requires that a large activation force be exerted by the user to make and retain an electrical connection.

The large amount of activation force required to achieve an electrical connection using conventional complaint connectors make use of the connectors difficult, which can result in the connector breakage if the connectors are not properly joined together, or can result in an electrical open circuit. Additionally, because the actuation force may be provided by a close interference fit between the electrical contacts themselves, repeated joining together and separation of the connectors causes the electrical contacts to become worn, thereby adversely affecting the integrity of the electrical connection.

Thus, there is a need for a compliant electrical connector that is constructed in a manner that minimizes the amount of contact force used to provide a sufficient degree of electrical contact between respective electrical contacts to ensure good electrical continuity. It is also desired that a compliant electrical connector be constructed in a manner that minimizes the amount of activation force exerted by a user to couple together the connector members. It is desirable that a compliant electrical connector be constructed in a manner that minimizes wear or damage to the electrical contacts due to repeated connector use. The compliant electrical connector also should be easy to use, and be constructed using conventional manufacturing techniques from conventional materials.

SUMMARY OF THE INVENTION

Compliant electrical connectors, constructed according to principles of this invention, include complementary male and female connector members designed to both facilitate connection with one another and to facilitate electrical connection between electrical contacts of respective male and female connector members, by rotational movement of the male connector member relative to the female connector member.

The compliant electrical connectors comprise a male connector member having an elongated body with a head at one body end, and a female connector member having a generally hollow body with an internal cavity. The male connector member includes at least one electrical contact disposed within the head adjacent a tip portion of the head. The head is positioned at an angle to the male connector member body. Each electrical contact is connected to an electrical wire that runs through the male connector body.

The female connector member includes at least one electrical contact disposed within the cavity and adapted to connect with respective electrical contacts on the male connector member, when the head of the male connector member is positioned in the cavity of the female connector member. The male and female connector members are each adapted to accommodate pivoting rotational movement of the head within the cavity to produce an electrical connection between the respective electrical contacts.

The male and female connector members each include means for releasably locking one another together, when electrical connection between respective electrical contacts is achieved, that is independent of the electrical contacts. In one embodiment, the releasable locking means comprise a latch mechanism in the form of a latch disposed along a wall portion of the female connector member and adapted to engage a catch disposed along an outside surface of the male connector member.

In another embodiment, the releasable locking means comprise an arm movably disposed along an outside surface of the male connection member and adapted to engage a shoe disposed on an outside surface of the female connector member.

The construction of compliant electrical connectors having a releasable locking means that is independent of the electrical contacts reduces the amount of activation force needed to achieve connection between the male and female connector members. The construction of an elongated male connector member that is rotatably coupled to the female connector member permits a further reduction in activation force do to lever arm action of the male connector member vis-a-vis the connection point disposed within the cavity.

Compliant electrical connectors of this invention have a reduced activation force, are easier to couple conventional interference-fit type electrical connectors, and allow for use of greater contact forces or large numbers of electrical contacts without adversely increasing the activation force.

BRIEF DESCRIPTION OF THE DRAWINGS

These and other features and advantages of the present invention will become appreciated as the same become better understood with reference to the specification, claims and drawings wherein:

DETAILED DESCRIPTION

Compliant electrical connectors, constructed according to principles of this invention, generally comprise a male connector member having a number of electrical contacts disposed therein, and a female connector member also having a number of electrical contacts disposed therein. The female connector member is constructed to accommodate both pivoting connection with the male connector member and rotational movement of the male connector member within the female connector member to provide electrical contact between respective electrical contacts. The compliant electrical connector also includes means for releasably locking the male connector member with the female connector member to maintain electrical connection between respective electrical contacts, and to prevent accidental separation. Compliant electrical connectors of this invention are designed to provide a sufficient degree of electrical connection between respective electrical contacts, while minimizing both the amount of contact force between the electrical contacts and the activation force exerted by a user, to produce such electrical contact and to releasably couple together the connector members.

Figures 1, 2:
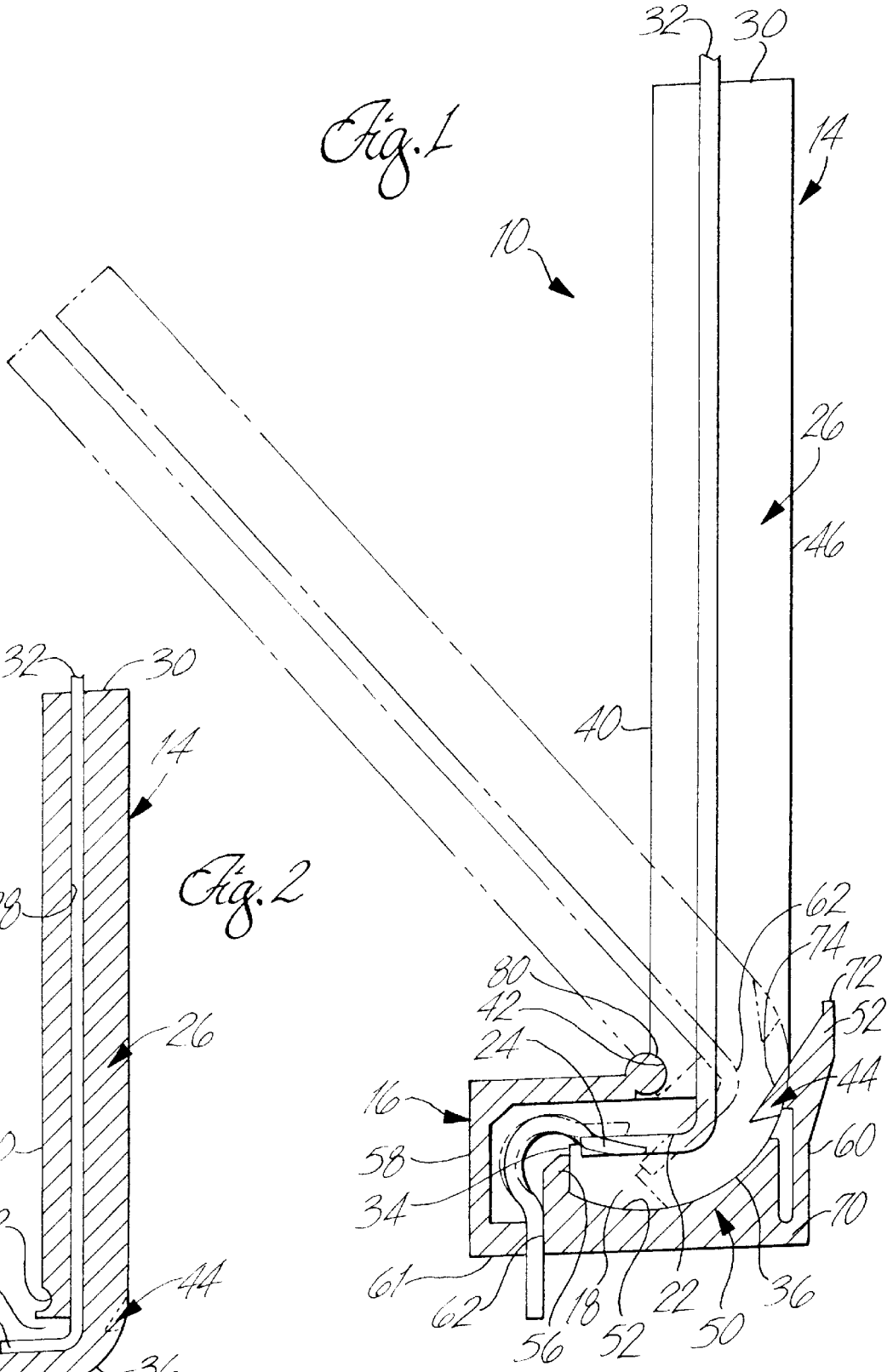
FIG. 1 is a cross-sectional view of a first embodiment of a compliant electrical connector, constructed according to principles of the invention, comprising male and female connector members illustrated in an assembled configuration.
FIG. 2 is a cross-sectional view of the male connector member of FIG. 1.

FIG. 1 illustrates a first embodiment of a rotational compliant electrical connector 10 comprising a male connecter member (MCM) 14 and a female connector member (FCM) 16. An angularly extending head portion 18 of the MCM 14 is disposed within in an internal cavity 20 of the FCM 16 (best shown in FIG. 3) so that electrical contacts 22 on the head 18 engage and make contact with electrical contacts 24 in the internal cavity 20. The MCM 14 is coupled together with the FCM 16 by a rotational pivoting action of the MCM relative to the FCM, and is maintained in coupled engagement by a releasable locking means described below.

Referring to FIGS. 1 and 2, the MCM 14 has a generally hollow elongated body 26. A channel 28 extends axially through the body from a tail 30 at one end of the body to the head 18 at an opposite end of the body. One or more electrically conductive wires 32 are disposed axially within the channel 28. The body can be configured having a length and wall thickness of sufficient dimension to provide a desired degree of strain relief to the wires 32 when the connector 10 is placed in operation. The MCM 14 is formed from an electrically nonconductive plastic material. In one embodiment, the MCM body 26 is preferably made of an electrical nonconductive thermoplastic material.

The head 18 of the MCM 14 extends at a perpendicular angle away from the axis of body 26 to a tip portion 34, giving the MCM a generally L-shaped profile. A bottom portion of the head 18 has a rounded outside surface 36 that extends to the tip 34 which has a flat surface oriented generally parallel with flat parallel outside surfaces of the long body 26. The electrical contacts 22 are disposed within a slot 38 formed in the head 18 and they project a distance outwardly away from a surface of the slot to promote electrical connection with corresponding electrical contacts 24 in the FCM. As best shown in FIG. 2, the slot 38 recessed in the head and opens toward a backside surface 40 of the body. The electrical wires 32 which extend through the body make a right angle bend within the head and are exposed along a lower side of the slot where they form the contacts 22. The tip 34 of the body and end portions of the electrical contacts 22 extend angularly outward away from a plane defined by the backside surface 40 of the body 26. An open portion of the slot 38 extends above the exposed contacts 22 which are supported by a lower portion of the head.

The electrical contacts 22 can be end portions of the wires 32 or can be separate electrically conductive elements that are attached to end portions of the wires. The electrical contacts 22 are fixedly disposed within the head 18 by conventional technique such as by pressed fit, adhesive attachment, or the like.

The MCM body 26 includes means for providing pivoting attachment with the FCM 16. In a preferred first embodiment, the means for providing pivoting attachment comprises a groove 42 disposed within the backside surface 40 of the body adjacent the slot 38. The groove 42 extends across the width of the body 26 from side part to side part and has a rounded shape. A rounded rib 80 on the FCM 16 is seated in the groove 42 and provides the rotational attachment, and described in more detail below. It is to be understood that means other than that specifically described and illustrated can be used to provide pivoting attachment according to principles of this invention. For example, a detent-type mechanism can be used.

The MCM body 26 also includes means for providing a releasable locking attachment to the FCM 16. In a preferred first embodiment, the releasable locking attachment is in the form of a latch mechanism, wherein the MCM body 26 includes a catch 44 disposed within a frontside surface 46 of the body adjacent the head 18. The latch catch 44 is in the form of a V-shaped groove that is centrally located along the width of the body at approximately the same level as the slot 38 that holds the contacts 22. The catch 44 has a bottom groove surface that has a slight upward angle, moving outwardly away from the body 26, and has a top groove surface that has an upward angle longer than the bottom groove surface, moving outwardly from the body. The catch 44 is sized and configured to receive a latch 52 disposed on the FCM 16.

Figure 3:
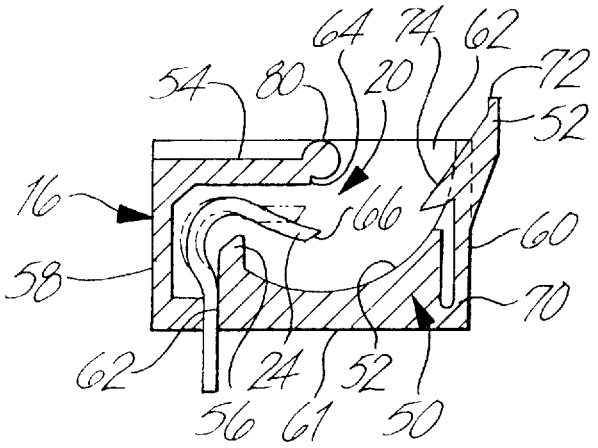
FIG. 3 is a cross-sectional view of the female connector member of FIG. 1.

Referring now to FIG. 3, the FCM 16 has a body 50 that can have a rectangular or square shape, depending upon the number of electrical contacts 24 it contains. The FCM body 50 is preferably formed from an electrically nonconductive thermoplastic material. The FCM body 50 includes an internal cavity 20 disposed having a rounded internal bottom surface 52 sized to complement and accommodate slidable placement of the rounded outside surface 36 of the MCM body head 18. The rounded bottom surface 52 of the cavity extends from a topside surface 54 of the FCM body 50 to a stop 56 in the form of a flat surface that projects upwardly from the rounded cavity bottom surface 52 into the cavity 20 toward the topside surface 54. The stop 56 is perpendicular to the topside surface of the body 50 and its function is to restrict rotational movement of the MCM body head 18 within the internal cavity 20 by contact of the tip 34 against the stop 56.

The topside surface 54 of the FCM body 50 extends a distance from a backside surface 58 on the FCM toward a frontside surface 60, and has an opening 62 between an end 64 of the topside surface 54 and a frontside surface 66 of the FCM body 50. The opening 62 is sized and configured to receive the MCM body head 18 into the internal cavity 20, as best shown in FIG. 1.

The electrical contacts 24 are disposed within a channel 62 extending upwardly from the bottom surface 61 of the FCM into a rear portion of the cavity behind the stop 56. The number of electrical contacts 24 disposed serially within the channel 58 depends on the number of electrical contacts 22 in the MCM body 26. The MCM and FCM body can each be configured to accommodate any number of respective electrical contacts therein, e.g., ranging from a single electrical contact to a hundred or more electrical contacts.

The electrical contacts 24 are each connected at a first end to an electrical conductive wire (not shown) that is routed from the FCM body to a desired electrical device, power source or the like. The electrical contacts 24 have a hook-shaped profile and are positioned so that a second end 66 projects outwardly from the channel 62 toward the frontside surface 60 over and beyond the stop 56 and into the internal cavity 20. The second ends 66 of the electrical contacts 24 are configured so they are not planar with the FMC topside surface 54 but, rather, so that they points slightly downwardly towards the FCM bottomside surface 61. In an example first embodiment, the second end 66 of each contact projects at an angle of approximately 30 degrees away from the plane defined by the topside surface 54.

The downward projection of the second end 66 of the electrical contacts 24 imposes a degree of contact force against the electrical contacts 22 on the MCM body 26 when the MCM body head 18 is rotatably pivoted into and locked into position within the inner cavity 20. When rotated to the locked position, the contacts 22 on the MCM exert an upward force on the ends of the hook-shaped contacts 24. The metal spring-like ends of the contacts 24 are biased under a reactive spring force that constantly applies a compliant contact force maintained between the contacts while the connector is in the locked position. In an example first embodiment, the downward projection of the second end 66 of the electrical contacts 24 is designed to produce a contact force between the electrical contacts 22 and 24 of the MCM and FCM, respectively, in the range of from one to ten ounces, i.e., sufficient to ensure good electrical connection therebetween under conditions where the electrical contacts are either clean or dirty. It is to be understood, however, that the electrical contacts can be configured to produce contact forces outside of this range, depending on the particular complaint electrical connector application.

The latch 52 is positioned along a middle portion of the frontside surface that corresponds to a position of the catch 44 on the frontside surface 46 of the MCM body 26. When the MCM body head 18 is positioned within the internal cavity, the tip 34 of the head is against the stop 56. The latch 52 is formed as a movable member of the FCM body, capable of being displaced inwardly and outwardly from the internal cavity. This allows a remote end 72 of the latch 52 to be moved laterally towards or away from the MCM body 26 when the MCM is rotated within the internal cavity.

The remote end 72 of the latch 52 has a V-shaped surface 74 directed inwardly into the cavity and shaped to complement and fit within the V-shaped catch 44 of the MCM body 26. The frontside surface 60 of the FCM body includes a latch opening (not shown) that extends therethrough and is positioned adjacent the V-shaped latch surface 74. The latch opening allows the V-shaped latch surface to project into the internal cavity. The V-shaped latch surface 74 includes a bottomside section angled slightly downward, moving outwardly away from the latch, and a topside section angled downward at an angle greater than the bottom side section, moving outwardly away from the latch. The bottomside and topside sections of the V-shaped latch surface 74 are each configured to complement and fit against respective sections of the V-shaped catch 44 when the MCM body head 18 is rotated into the internal cavity 20 and the tip 34 is placed against the stop 56.

The configurations of the V-shaped latch surface 74 and the corresponding V-shaped catch surface 44 are designed to both permit easy placement of the latch within the catch, when the MCM body head is rotated within the FCM internal cavity, and to prevent unwanted disengagement of the MCM and FCM bodies by oppositely directed rotational movement of the MCM body. Once the MCM body head 18 is rotated to a position within the internal cavity where the latch 52 engages the catch 44, the MCM body is locked into the position shown in solid lines in FIG. 1 and can only be released by prying the remote end 72 of the latch outwardly away from the MCM body so that the latch disengages the catch.

A rib 80 extends away from the end 64 of the FCM body topside surface 54 toward the FCM body frontside surface 60. The rib 80 extends along the width of the end 64 and has a round surface shaped to fit within the groove 42 disposed within the MCM body to provide pivoting movement of the MCM body vis-a-vis the FCM body.

Referring back now to FIG. 1, the MCM 14 and FCM 16 are coupled together by positioning the tip 34 of the MCM body head 18 over the FCM body opening 62 so that the MCM body 26 is parallel with the topside surface 54 of the FCM body 50. The MCM body is lowered toward the FCM body so that the rib 80 of the FCM body is inserted within the groove 42 of the MCM body. When the rib is inserted within the groove, the tip 34 of the MCM body head is positioned adjacent the opening 62 and is directed inwardly toward the internal cavity 20. After the rib is inserted within the groove, the MCM body is rotated relative to the FCM body, causing the tip 34 to enter the internal cavity 20, and causing the rounded surface 36 of the MCM body head to rotate against the rounded surface 52 facing the cavity. The MCM body is rotated in the clockwise direction shown in FIG. 1, from the position shown in phantom lines to the upright position shown in solid lines.

Continued rotation of the MCM body relative to the FCM body causes the second end 66 of the electrical contacts 24 within the FCM to engage the electrical contacts 22 of the MCM and impose a compliment contact force between them. Further rotation of the MCM body relative to the FCM body causes the latch 52 to engage the catch 44, and causes the tip 34 to engage the stop 56. When placed in this position, the MCM is releasably locked with the FCM to form a compliant electrical connection between the respective electrical contacts 22 and 24. In an example first embodiment, the MCM is releasably locked together with the FCM when the MCM is moved to a position perpendicular to the FCM.

Figure 5:
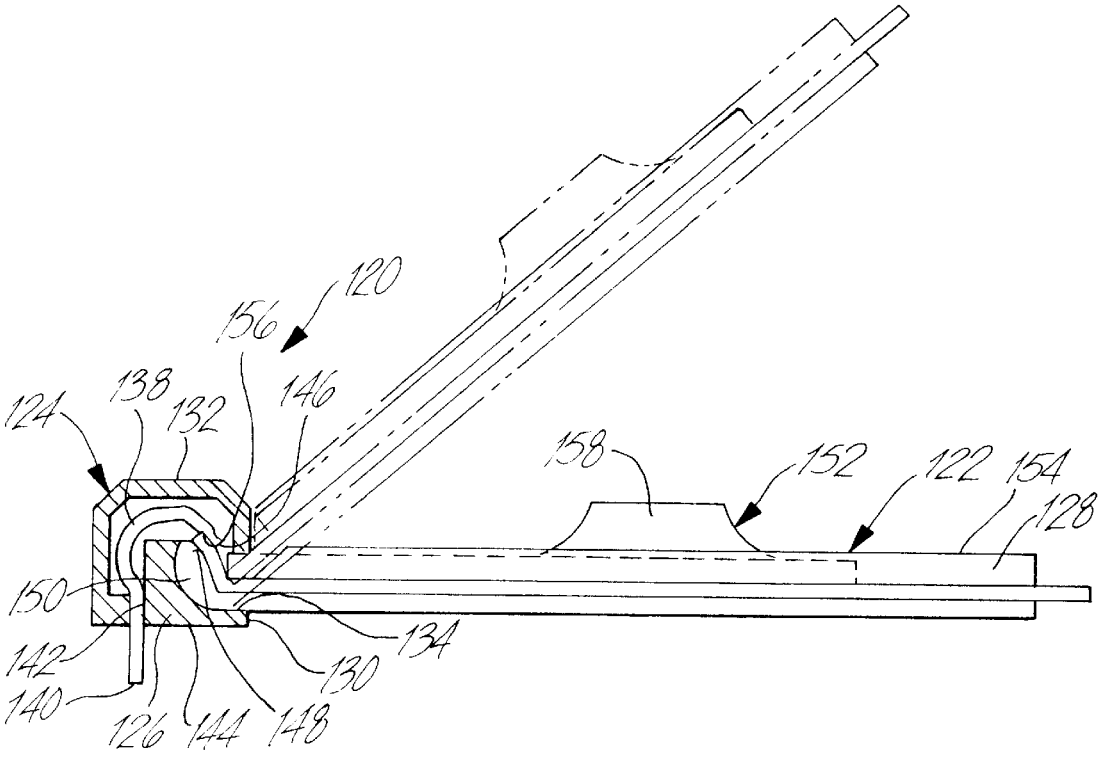
FIG. 5 is a cross-sectional view of a third embodiment of a compliant electrical connector, constructed according to principles of the invention, comprising male and female connector members illustrated in an assembled configuration.

Although a first embodiment of the compliant electrical connector is described and illustrated that provides a releasable locking connection between the MCM and FCM by rotating the MCM approximately 90 degrees relative to the FCM, it is to be understood that other embodiments of the connector can be constructed according to principles of this invention to produce a releasable locking connection when the MCM is rotated by a lesser or greater amount. The amount of rotational movement needed to provide a releasable locking connection between the MCM and FCM depends upon the particular application for the rotatable compliant electrical connector. For example, the MCM and FCM can be constructed to accommodate certain applications where limited space is available to provide a releasable locking connection by rotating the MCM approximately 45 degrees relative to the FCM (as shown in FIG. 5).

A key feature of compliant electrical connectors constructed according to principles of this invention is the ability to achieve a compliant connection between the MCM and FCM, and to achieve good electrical contact between respective electrical contacts, by rotational movement of the MCM relative to the FCM. Connection via rotational movement, rather that by linear insertional movement, reduces the amount of activation force exerted by a user and needed to overcome the contact force between electrical contacts in the MCM and FCM. For example, the construction of the compliant electrical connector can reduce the activation force from about 5 to 20 times the combined contact force of the electrical contacts in the connector. It is to be understood that the amount of activation force reduction may vary, as it depends upon the length of the male connector member which in turn depends upon the particular connector application.

In an example first embodiment, the MCM body has a length approximately 15 times the distance measured between the groove 42 and the electrical contacts 22 which acts to reduce the activation force needed to overcome the combined contact force of the connector by a factor of approximately 15. For example, the overall or combined contact force for a compliant electrical connector comprising twenty MCM and FCM electrical contacts that each have a contact force of approximately one ounce each, is approximately twenty ounces. For conventional compliant electrical connectors having male and female coupling members constructed to couple by linear insertion, a user would have to exert an activation force of at least twenty ounces to achieve an electrical connection. The activation force that would need to be imposed to achieve connection between an MCM and FCM, constructed according to principles of this invention, by rotating the end 30 of the MCM to overcome the combined twenty-ounce contact force would be 20/15 or approximately 1.3 ounces, i.e., 15 times less than that required for the conventional connector.

One advantage of the reduced activation force provided by rotatable compliant electrical connectors of this invention is that it permits large numbers of electrical contacts to be made using a single connector without producing user difficulty. Another advantage of the reduced activation force is that allows an opportunity for greater contact forces to be applied between electrical contacts without adversely increasing the activation force needed to achieve connection between electrical connector members. This permits embodiments of the connector to be constructed that provide a high degree of contact force between respective electrical contacts for applications where increased contact force is needed to establish good electrical connection, e.g., between dirty electrical contacts, without requiring that a large amount of activation force be exerted to overcome the same.

Another key feature of compliant electrical connectors constructed according to principles of this invention is the design of the releasible locking mechanism, to maintain the MCM and FCM in a coupled position, that does not rely on the interconnection between the electrical contacts of the MCM and FCM, e.g., that does not rely on an interference fit between male and female electrical contacts. The design of an independent releasible locking mechanism serves to limit the amount of contact force to only that amount needed to perfect a good electrical connection between respective the electrical contacts, thereby reducing both the combined contact force between respective contacts and the associated activating force that is needed to overcome the same.

Figure 4:
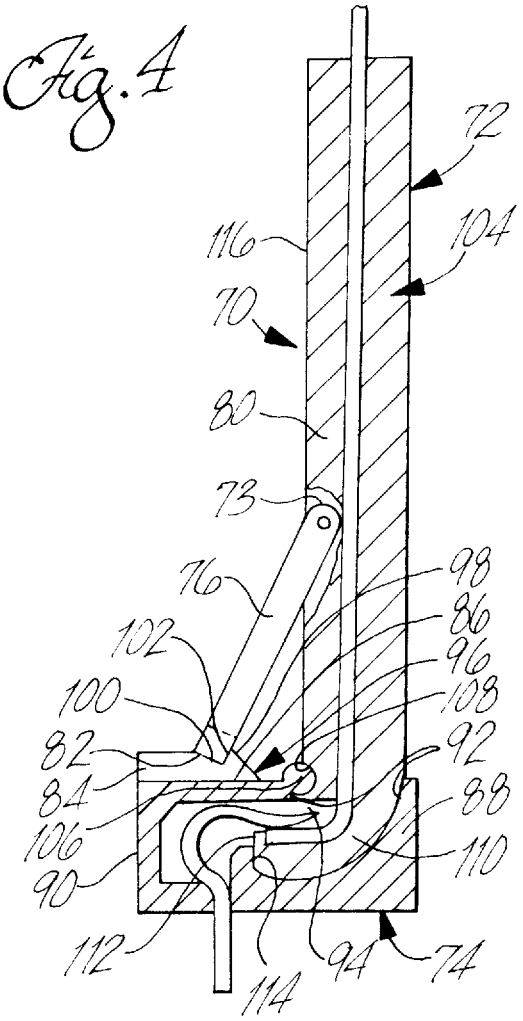
FIG. 4 is a cross-sectional view of a second embodiment of a compliant electrical connector, constructed according to principles of the invention, comprising male and female connector members illustrated in an assembled configuration.

Referring to FIG. 4, a second embodiment of a compliant electrical connector 70, constructed according to principles of this invention, includes an MCM 72 and a FCM 74 that are each configured in a manner similar to that described and illustrated for the first embodiment. The difference between the first and second connector embodiments is in the type of mechanism used to provide releasible locking attachment between the MCM and FCM.

The MCM 72 includes an arm 76 pivotally attached at one end 78 to a side portion 80 of the MCM. The MCM can include a single arm attached to one side portion of the MCM, or can include an arm having a C-shaped configuration with two ends each pivotally attached to respective oppositely-faced side portions. In a preferred second embodiment, the MCM includes a single arm 76 having a base portion 82 at an end opposite to the attached end 78. The base portion is sized and configured to fit within a shoe 84 disposed on a topside surface 86 of the FCM body 88.

The shoe 84 is positioned on the topside surface between a backside surface 90 of the FCM body 88 and an opening 92 to an internal cavity 94. The shoe 84 includes a ramp surface 96 facing the opening 92. The shoe has a first ramp section 98 and a second ramp section 100. The first ramp section 98 extends from the topside surface 86 at an angle toward the backside surface 90. The second ramp section 100 extends from the first ramp section 98 to a portion of the shoe adjacent the backside surface 90. A stop 102 is formed between the first and second ramp sections. In an example second embodiment, the first ramp section 98 extends upwardly away from the topside surface 98 at an angle of approximately 45 degrees, and the second ramp section 100 extends away from the topside surface 86 at an angle of approximately 30 degrees.

The MCM 72 is rotated into releasable locking engagement with the FCM 74 by (1) placing the arm 76 adjacent the MCM body 104 before engaging the rib 106 and groove 108, (2) rotating the MCM body 104 relative to the FCM body 88 so that the MCM body head 110 enters the internal cavity 94, and (3) continuing to rotate the MCM body until the tip 112 of the MCM body head engages the stop 114 within the internal cavity. As the MCM body is rotated, so that the tip approaches the stop, the base 82 of the arm 76 is rotated outwardly away from the backside surface 116 of the MCM body so that it is allowed to slide over the first ramp section 98 of the shoe 84, and onto the second ramp section 100, where it is prevented from exiting the shoe by reverse movement by the stop 102. The arm 76 is released from the shoe by slightly rotating the MCM body, to cause the arm to disengage from the stop, and by rotating the stand inwardly toward or outwardly away from the MCM body.

Referring to FIG. 5, a third embodiment of a compliant electrical connector 120, constructed according to principles of this invention, includes an MCM 122 and a FCM 124 each constructed generally similar to that previously described and illustrated for the first connector embodiment. Unlike the first embodiment, however, the FCM body 126 is configured to accommodate connection with the MCM body 128 from a frontside surface 130 rather than from a topside surface 132. Accordingly, the frontside surface 130 of the FCM body includes an opening 134 that leads to an internal cavity 136. Electrical contacts 138 having a hook-shaped profile are disposed within the cavity 136, and include a first end 140 that extends through a channel 142 in a bottomside surface 144 of the FCM body, and an opposite second end 146 that projects within the cavity adjacent the opening 134. The second end 146 of each electrical contact is constructed to accommodate contact with electrical contacts 148 in a head portion 150 of the MCM body, and are configured to provide a desired degree of contact force therebetween.

The MCM body includes a slide mechanism 152 slidably disposed axially along a frontside surface 154. The slide mechanism resides within a groove (not shown), and includes an end 156 positioned adjacent the head portion 150 of the MCM body. The slide mechanism slides within the groove such that the slide end 156 moves toward and away from the electrical contacts 148 in the MCM body. A lever 158 disposed along a top portion of the slide mechanism 152 facilitates slidable displacement of the slide mechanism within the groove by a user.

The MCM body is coupled to the FCM body, and connections between respective electrical contacts are made by placing the MCM body at an angle to the frontside surface 130 of the FCM body 126 so that the head portion of the MCM body is allowed to enter the internal cavity 136. In a preferred third embodiment, the MCM body is placed at an angle that extends upwardly and away from a plane running along the FCM body bottomside surface 144 by approximately 45 degrees. Once the head 150 is placed into the cavity so that rounded surfaces of the head and cavity are in contact with one another, the MCM body is rotated downwardly, causing the electrical contacts 148 and 138 to come into engagement with each other. When the MCM body is rotated into a position parallel with the plane running along the bottomside surface 147 of the FCM, the slide mechanism 158 is slidably displaced toward the head 150 so that slide end 156 enters the cavity and engages and fills the opening 134 to form a releasible locking attachment between the MCM body and the FCM body. Accordingly, in a preferred third embodiment, electrical connection is produced between electrical contacts in the MCM and FCM, and releasable locking attachment is made by rotationally moving the MCM body relative to the FCM body by approximately 45 degrees.

Action of the slide end 156 against the opening 134 prevents the MCM body from being accidentally rotated upwardly within the cavity to disengage the electrical contacts. The MCM body is released from its locked position by slidably displacing the slide mechanism 152 away from the head 150, causing the slide end 136 to be retracted outwardly away from the cavity 136 and the opening 134.

Figure 6:
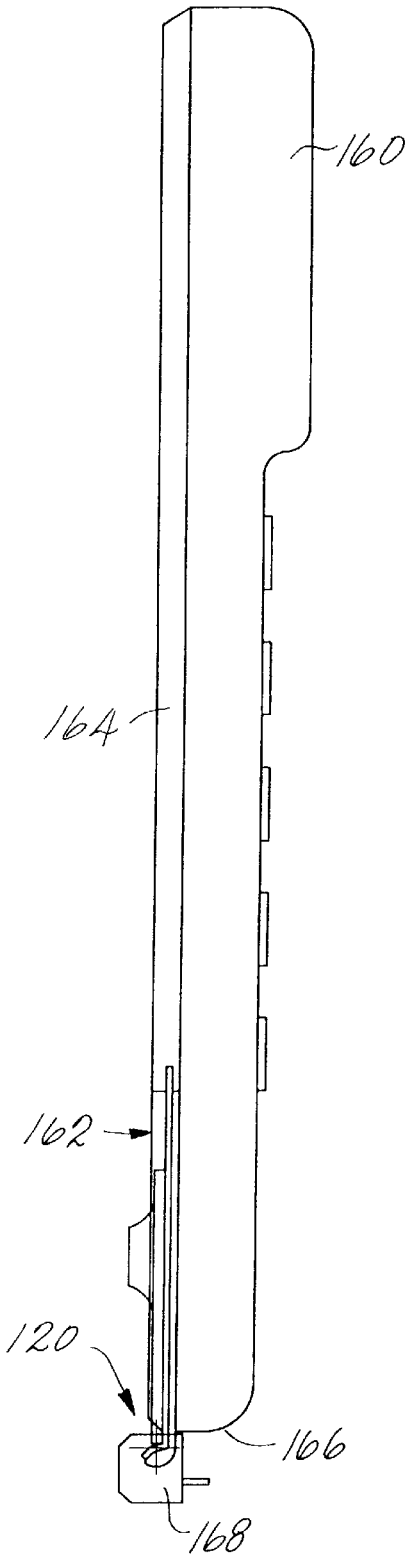
FIG. 6 is an elevational view the compliant electrical connector of FIG. 5 attached to a backside surface of a phone to provide electrical connection between the phone and an external device.

FIG. 6 illustrates use of the third embodiment of the compliant electrical connector 120 with a telephone 160, cellular, cordless or otherwise, to effect electrical connection with a base unit, electrical power source, auxiliary electrical device and the like. The MCM body 162 is built into a backside surface 164 of the telephone 160 adjacent a bottom end 166 of the phone to facilitate coupling with the FCM body 168

Although particular embodiments of compliant electrical connectors have been specifically described and illustrated, it is to be understood that variations or alternative embodiments apparent to those skilled in the art are meant to be within the scope of this invention. For example, embodiments of the compliant electrical connector have been described having particular dimensions. It is to be understood that the dimensions provided were only illustrative of one size to accommodate use in a particular application, and that compliant electrical connectors may be constructed according to principles of this invention having dimensions different from that described and illustrated to accommodate use with a variety of different electrical devices. Since many such variations may be made, it is to be understood that within the scope of the following claims, this invention may be practiced otherwise than specifically described.

What is claimed is:

1. A compliant electrical connector comprising:

a male connector member having an elongated body with a head at one end, wherein the head is positioned perpendicular to the body and includes at least one electrical contact fixedly disposed therein that projects from a surface of the head adjacent a tip portion;

a female connector member having a hollow body and an internal cavity therein, wherein the internal cavity includes at least one electrical contact disposed therein to connect with and impose a force against the electrical contact of the male connector member when the head is placed within the cavity and rotated therein;

a latch disposed along a frontside surface of the female connector member; and a latch catch disposed along a frontside surface of the male connector member adjacent the head, wherein the internal cavity includes a stop projecting therein to limit rotational movement of the head inside of the internal cavity, and wherein the latch catch is adapted to accommodate placement of the latch therein when the head contacts the stop to provide a releasibly locking attachment between the male connecting body and the female connecting body.

2. A compliant electrical connector as recited in claim 1 wherein the male connector body head has a round-shaped outside surface.

3. A compliant electrical connector as recited in claim 2 wherein the internal cavity has a rounded-shaped inside surface configured to complement the head outside surface, and wherein the female connector member has an opening to permit placement of the head within the cavity.

4. A compliant electrical connector as recited in claim 1 further comprising means disposed on both the male connector member body and the female connector body to facilitate pivoting rotational movement of the male connector member body relative to the female connector.

5. A compliant electrical connector as recited in claim 4 wherein the means to facilitate pivoting rotational movement of the male connector member body relative to the female connector comprises:

a groove that extends across a backside surface of the male connector member adjacent the head; and a rib that extends across a topside surface of the female connector member adjacent an opening, wherein placement of the rib within the groove permits pivoting rotational movement of the male connector member relative to the female connector member.

6. A compliant electrical connector as recited in claim 1 wherein the electrical contact in the female connector member is disposed within a channel in the cavity and has a hook-shaped profile with one end that projects into the cavity.

7. A compliant electrical connector as recited in claim 1 wherein the electrical contact in the female connector member is constructed to provide a contact biasing force in the range of from between 1 to 20 ounces, and wherein the male and female connector members are constructed to reduce an activation force needed to join the male and female connector members together to a level that is less than a combined contact force for the electrical contacts within the connector.

8. A compliant electrical connector as recited in claim 7 wherein the male and female connector members are constructed to reduce the activation force by a multiple in the range of from 5 to 20 times that of a combined contact force for the electrical contacts within the connector.

9. A compliant electrical connector comprising:

a male connector member having an elongated body with a head at one end, wherein the head is positioned perpendicular to the body and includes at least one electrical contact fixedly disposed therein that projects from a surface of the head adjacent a tip portion;

a female connector member having a hollow body and an internal cavity therein, wherein the internal cavity includes at least one electrical contact fixedly disposed therein to connect with and impose a force against the electrical contact of the male connector member when the head is placed within the cavity and rotated therein;

an elongated member pivotally mounted at one end adjacent a backside surface of the male connector member, wherein the elongated member has a base at an opposite non-connected end; and a shoe disposed on a topside surface of the female connector member, wherein the shoe includes a ramp surface that faces toward an opening to the internal cavity, wherein the cavity includes a stop projecting therein to limit rotational movement of the head inside of the cavity, and wherein the ramp surface includes a stop adapted to accommodate placement of the elongated member thereagainst when the is head disposed within the cavity and rotated completely therein so that a tip of the head contacts the stop within the cavity.

10. A compliant electrical connector comprising:

a male connector member having an elongated body with a head at one end, wherein the head is positioned perpendicular to the body and includes at least one electrical contact fixedly disposed therein that projects from a surface of the head adjacent a tip portion;

a female connector member having a hollow body and an internal cavity therein, wherein the internal cavity includes at least one electrical contact fixedly disposed therein to connect with and impose a force against the electrical contact of the male connector member when the head is placed within the cavity and rotated therein;

a slide mechanism that is slidable disposed axially along an outside surface of the male connector member, wherein the slide mechanism includes a slide end that is disposed adjacent the head, wherein when the head is disposed within the cavity, and wherein slidable displacement of the slide mechanism toward the head causes the slide end to enter the cavity and abut against the female connector member to prohibit rotational movement of the male connector member relative thereto.

11. A compliant electrical connector comprising:

a female connector member having a generally hollow body and an internal cavity therein, wherein the cavity is configured having a round-shaped inside wall surface, wherein the female connector member includes:

a cavity opening that extends through a wall portion of the female connector member body to the internal cavity; and at least one electrical contact fixedly disposed within the cavity;

a male connector member having an elongated body, wherein the male connector member includes:

a head at one end of the body, wherein the head is oriented perpendicular to the body, wherein the head has a round-shaped outside surface that is adapted to be rotatably placed into the cavity;

groove that extends across an outside surface of the male connector member adjacent the head; and at least one electrical contact fixedly disposed within the head and positioned adjacent a tip portion of the head to facilitate contact with a respective electrical contact of the female connector member when the head is rotated within the cavity;

wherein the female connector member further comprises a rib that extends across an outside surface of the female connector member adjacent the cavity opening, wherein placement of the rib within the groove permits pivoting rotational movement of the male connector member relative to the female connector member;

wherein the electrical contact in the female connector member is adapted to impose a force onto the electrical contact in the male connector member to ensure electrical connection therebetween;

wherein the male and female connector members are constructed to reduce an activation force needed to join the male and female connector members together to a level that is less than a combined contact force for the electrical contacts within the connector; and means to facilitate releasible locking engagement between the male connector member and the female connector member when the head is rotated to a terminal position within the internal cavity to prevent a force provided by the electrical contact of the female connector member to expel the male connector member therefrom.

12. A compliant electrical connector as recited in claim 11 further comprising:

a groove that extends across an outside surface of the male connector member adjacent the head; and a rib that extends across an outside surface of the female connector member adjacent the cavity opening, wherein placement of the rib within the groove permits pivoting rotational movement of the male connector member relative to the female connector member.

13. A compliant electrical connector as recited in claim 11 wherein the means to facilitate releasible locking attachment of the male connecting body with the female connecting body comprises:

a latch disposed along a wall surface of the female connector member, wherein the latch is adapted to retractably project into the internal cavity; and a latch catch disposed along an outside surface of the male connector member adjacent the head, wherein the cavity includes a stop projecting therein to limit rotational movement of the head inside of the cavity, and wherein the latch catch is adapted to accommodate placement of the latch therein when the is head disposed within the cavity and rotated completely therein so that a tip portion of the head contacts the stop.

14. A compliant electrical connector comprising:

a female connector member having a generally hollow body and an internal cavity therein, wherein the cavity is configured having a round-shared inside wall surface, wherein the female connector member includes:

a cavity opening that extends through a wall portion of the female connector member body to the internal cavity; and at least one electrical contact fixedly disposed within the cavity;

a male connector member having an elongated body, wherein the male connector member includes:

a head at one end of the body, wherein the head is oriented perpendicular to the body, wherein the head has a round-shaped outside surface that is adapted to be rotatable placed into the cavity; and at least one electrical contact fixedly disposed within the head and positioned adjacent a tip portion of the head to facilitate contact with a respective electrical contact of the female connector member when the head is rotated within the cavity;

wherein the electrical contact in the female connector member is adapted to impose a contact force upon the electrical contact in the male connector member to ensure electrical connection therebetween;

wherein the male and female connector members are constructed to reduce an activation force needed to join the male and female connector members together to a level that is less than a combined contact force for the electrical contacts within the connector;

an elongated member pivotally mounted at one of its end to an adjacent outside surface of the male connector member, wherein the elongated member has a base at its opposite non-connected end; and a shoe disposed on an outside surface of the female connector member, wherein the shoe includes a ramp surface that faces toward an opening to the internal cavity, wherein the cavity includes a stop projecting therein to limit rotational movement of the head inside of the cavity, and wherein the ramp surface includes a stop adapted to accommodate placement of the elongated member thereagainst when the is head disposed within the cavity and rotated completely therein so that a tip portion of the head contacts the stop within the cavity.

15. A compliant electrical connector comprising:

a female connector member having a generally hollow body and an internal cavity therein, wherein the cavity is configured having a round-shaped inside wall surface, wherein the female connector member includes:

a cavity opening that extends through a wall portion of the female connector member body to the internal cavity; and at least one electrical contact fixedly disposed within the cavity;

a male connector member having an elongated body, wherein the male connector member includes:

a head at one end of the body, wherein the head is oriented perpendicular to the body, wherein the head has a round-shaped outside surface that is adapted to be rotatable placed into the cavity; and at least one electrical contact fixedly disposed within the head and positioned adjacent a tip portion of the head to facilitate contact with a respective electrical contact of the female connector member when the head is rotated within the cavity;

wherein the electrical contact in the female connector member is adapted to impose a contact force upon the electrical contact in the male connector member to ensure an electrical connection therebetween;

wherein the male and female connector members are constructed to reduce an activation force needed to join the male and female connector members together to a level that is less than a combined contact force for the electrical contacts within the connector; and a slide mechanism that is slidable disposed axially along an outside surface of the male connector member, wherein the slide mechanism includes a slide end that is disposed adjacent the head, and wherein the slide mechanism is adapted to permit slidable displacement of the slide end toward the head to enter the cavity and abut against the female connector member when the head is rotatably disposed within the cavity to prohibit rotational movement of the male connector member relative thereto.

16. A compliant electrical connector comprising:

a female connector member having a generally hollow body and an internal cavity therein, wherein the female connector member includes:

a cavity opening that extends through a wall portion of the female connector member body;

a rib that extends across an outside surface of the female connector member body adjacent the opening;

a latch movably disposed along a wall portion of the female connector member body adjacent the cavity and opposite from the rib, wherein a face portion the latch projects within the cavity;

at least one electrical contact fixedly disposed within the cavity having a hook-shaped profile; and a male connector member having an elongated body, wherein the male connector member includes:

a head at one end of the body, wherein the head is oriented perpendicular to the body, and wherein the head is adapted to be rotatably placed into the cavity;

a groove that extends across an outside surface of the male connector member adjacent the head, wherein connection between male and female connector members is achieved by placing the rib within the groove and rotating the male connector member approximately 90 degrees with respect to the female connector member to a terminal position within the internal cavity;

a latch catch disposed along an outside surface of the male connector member adjacent the head and opposite from the groove, wherein the latch catch is adapted to accommodate placement of the latch therein when the head is rotated to a terminal position within the cavity; and at least one electrical contact fixedly disposed within the head and positioned adjacent a tip portion of the head to facilitate contact with a respective electrical contact of the female connector member when the head is rotated within the cavity, wherein the electrical contact within the female connector imposes a contact force against the electrical contact of the male connector member to provide an electrical connection therebetween.

17. A compliant electrical connector as recited in claim 16 wherein the cavity includes a stop disposed therein that is configured to contact the tip of the head when the head is rotated within the cavity to define a terminal position of the head within the cavity.

18. A compliant electrical connector as recited in claim 16 wherein the head is in a terminal position within the cavity when the male connector member body is placed perpendicular to the opening in the female connector member body.

19. A compliant electrical connector as recited in claim 16 wherein the electrical contact in the female connector member is configured to impose a contact force in the range of from 1 to 20 ounces upon a respective electrical contact in a male connector member when the male connector member body is in a terminal position.

20. A compliant electrical connector as recited in claim 19 wherein the male and female connector members are constructed to reduce an activation force needed to join the male and female connector members together to a level that is less than a combined contact force for the electrical contacts within the connector.

21. A compliant electrical connector as recited in claim 19 wherein the male and female connector members are constructed so that the activation force needed to connect the member together is in the range of from 5 to 20 times less than a combined contact force for the electrical contacts in the members.

* * * * *

UNITED STATES PATENT AND TRADEMARK OFFICE

CERTIFICATE OF CORRECTION

PATENT NO. : 5,772,459
DATED : June 30, 1998
INVENTOR(S) : Mark A. Swart

It is certified that error appears in the above-indentified patent and that said Letters Patent is hereby corrected as shown below:

Column 1, lines 49, 55, replace "complaint" with -- compliant -- (both occurrences).
Column 2, line 61, after "force" delete "do".
Column 3, line, after "elevational view" insert -- of --.
Column 3, line 58, after "within" delete "in".
Column 4, line 21, after "slot 38" insert -- is --.
Column 5, line 40, change "points" to -- point --.
Column 5, line 65, replace "complaint" withb -- compliant --.
Column 6, line 66, replace "compliment" with -- complement --.
Column 7, line 31, replace "that" with -- than --.
Column 7, line 67, after "is that" insert -- it --.
Column 8, lines 19, 20, replace "between respective the electrical" with -- between the respective electrical --.
Column 11, line 45, replace "is head" with -- head is --.
Column 11, line 61, change "slidable" to -- slidably --.
Column 12, line 20, before "groove that extends" insert -- a --.
Column 13, line 4, replace "is head" with -- head is --.
Column 13, line 22, change "rotatable" to -- rotatably --.
Column 13, line 38, change "end" to -- ends --.
Column 13, line 49, replace "is head" with -- head is --.

UNITED STATES PATENT AND TRADEMARK OFFICE

CERTIFICATE OF CORRECTION

PATENT NO. : 5,772,459
DATED : June 30, 1998
INVENTOR(S) : Mark A. Swart

It is certified that error appears in the above-indentified patent and that said Letters Patent is hereby corrected as shown below:

Column 14, line 2, change "rotatable" to -- rotatably --.
Column 14, line 17, change "slidable" to --slidably--.
Column 14, line 38, after "face portion" insert -- of --.

Signed and Sealed this

Twenty-third Day of February, 1999

*Attest:*

Q. TODD DICKINSON

*Attesting Officer*

*Acting Commissioner of Patents and Trademarks*